United States Patent [19]

Wildey

[11] Patent Number: 4,606,504

[45] Date of Patent: Aug. 19, 1986

[54] PRESSURE-ASSISTED CENTRIFUGAL GRINDING

[75] Inventor: Allan J. Wildey, Brantford, Canada

[73] Assignee: AMCA International Limited, Brantford, Canada

[21] Appl. No.: 732,654

[22] Filed: May 10, 1985

[51] Int. Cl.[4] ..... B02C 19/12

[52] U.S. Cl. ..... 241/28; 241/275

[58] Field of Search ..... 241/28, 244, 275, 280, 241/281, 282, 261.2, 261.3

[56] References Cited

U.S. PATENT DOCUMENTS

| | | | |
|---|---|---|---|
| 3,948,449 | 4/1976 | Logan et al. | 241/280 X |
| 3,991,946 | 11/1976 | Berggren | 241/280 X |
| 4,474,335 | 10/1984 | Wildey | 241/28 X |

FOREIGN PATENT DOCUMENTS

| | | | |
|---|---|---|---|
| 2135116 | 2/1973 | Fed. Rep. of Germany | 241/280 |
| 1394215 | 2/1964 | France | 241/280 |
| 595445 | 2/1978 | U.S.S.R. | 241/280 |

*Primary Examiner*—Mark Rosenbaum

*Attorney, Agent, or Firm*—Sim & McBurney

[57] ABSTRACT

A method and apparatus for grinding woodchips into pulp provides an internal grinding surface of circular section defining a cavity in which a rotor rotates. The rotor has a pocket extending to the grinding surface from an inlet spaced inwardly from the grinding surface, and the rotation of the rotor gives rise to centrifugal force urging woodchips against the surface, the woodchips entering at the inlet. The woodchips form a compact plug of material filling the pocket adjacent the surface, and the woodchips are ground to pulp and then removed from the surface to a discharge. A pressure differential is placed across the plug of material in the sense to urge the woodchips in the plug more strongly against the grinding surface, so that the woodchips can press with a satisfactory grinding force against the surface without requiring an excessive rotational speed.

12 Claims, 4 Drawing Figures

PRESSURE-ASSISTED CENTRIFUGAL GRINDING

This invention relates generally to the centrifugal grinding of woodchips into pulp, in which an internal grinding surface of circular section, typically cylindrical, defines a cavity in which a rotor rotates. The rotor provides at least one pocket extending to the grinding surface from an inlet spaced inwardly from the grinding surface. Rotation of the rotor gives rise to centrifugal force which urges against the surface woodchips which enter at the inlet.

BACKGROUND OF THIS INVENTION

Reference is made to my own earlier U.S. Pat. No. 4,474,335, dated Oct. 2, 1984, and entitled "Apparatus for Centrifugal Pulpwood and Woodchip Grinding". This patent basically discloses an apparatus operating as described in the previous section, with the addition of means incorporated in the rotor for applying water to the grinding surface, thus utilizing the centrifugal force to increase the water pressure at a spraying location remote from the axis of rotation.

It will be appreciated that the apparatus set forth in the aforesaid U.S. Pat. No. 4,474,335 represents a departure from conventional grinding procedures, in which the wood is urged against the outer periphery of a typically cylindrical grinding stone. In connection with this conventional procedure, it is known to grind the wood under superatmospheric pressure, thus permitting grinding temperatures higher than in the standard stone groundwood (SGW). In U.S. Pat. Nos. 3,808,090 and 3,948,449, a process is described for improving the groundwood pulp by grinding wood in a closed grinding chamber in a pressurized gaseous atmosphere. In the two patents just named, the wood is fed in and the superatmospheric pressure in the grinding chamber can be maintained only so long as the grinding of a wood batch continues. However, when a new wood batch must be fed into the magazine, the magazine must be opened and the pressure of the grinding surface falls to atmospheric. Thus, the grinder of these two patents does not work in a continuously pressurized atmosphere.

Further developments in this technology are exemplified in Canadian Pat. No. 1,097,118, issued Mar. 10, 1981, and U.S. Pat. Nos. 4,270,703 and 4,274,600, issued June 2, 1981 and June 23, 1981, respectively. These patents are assigned to Oy Tampella Ab. In the Oy Tampella process, a feed chamber upstream of the grinding chamber has two pressure seals, one to the atmosphere and one to the grinding chamber. Thus, the feed chamber acts as a double-lock seal, to allow the pressure in the grinding chamber always to be maintained above atmospheric. By the use of this method, the pressure in the chamber may reach as high as several bar, and temperatures at the grinding stone surface may climb well above the standard pressure boiling point.

The apparatus set forth in my earlier U.S. Pat. No. 4,474,335, identified above, presents a desirable alternative to the SGW process and the pressurized groundwood (PGW) process, in that the centrifugal effect generated by the rotor can be utilized not only to press the pulpwood or woodchips against the grinding surface, but also to create pressurized effects without the need for a pressure lock mechanism. In other words, because the material is being "flung" against the internal grinding surface, the water in the slurry acts as if it were pressurized above atmospheric, and can attain temperatures above the normal boiling point of water without boiling.

It is now appropriate to discuss a further aspect that has been encountered in connection with the centrifugal grinding apparatus disclosed in my earlier U.S. Pat. No. 4,474,335. While the apparatus described in that patent functions quite satisfactorily, it has been concluded that for centrifugal grinders of acceptable size, the necessary rotational rate to achieve the required grinding force through the centrifugal effect may result in a rubbing speed which is faster than that which produces optimum pulp quality. More specifically, for a centrifugal grinder of acceptable dimensions, rubbing speeds on the order of 10,000 to 12,000 feet per minute may be required in order to achieve the necessary grinding force through the centrifugal effect. However, practical experience gained from conventional grinders suggests that optimum pulp quality occurs at speeds of less than 6,000 feet per minute.

It has been concluded that the solution to this problem does not lie in slowing down the rotor to achieve a rubbing speed of 6,000 feet per minute or less, since the centrifugal grinding force varies as the square of the rotational speed, and would drop to one quarter of that achieved at a rubbing speed of 12,000 feet per minute.

It can thus be seen from the above discussion that a desirable development in connection with centrifugal grinders would be one which provided an extra pressure factor urging woodchips against the internal grinding surface, so that it would not be necessary to rotate the rotor so fast that the rubbing speed produced an unacceptable pulp quality.

To complete the summary of the prior art, reference may be had to U.S. Pat. No. 4,456,503 issued June 26, 1984 to Bystedt, which discloses the use of a pressurized grinding chamber primarily for the purpose of raising the temperature to between 110° and 130° C., at which temperature the lignin in the wood bond softens. The patent describes a steam-tight plug of fibers which is intended to contain the pressure of steam ahead of the plug, in order that the general temperature of the woodchip grinding region can be raised above the boiling point at atmospheric pressure.

Other U.S. Pat. Nos. of interest are the following: U.S. Pat. No. 4,017,356, issued Apr. 12, 1977 to Bystedt, U.S. Pat. No. 4,445,973, issued May 1, 1984 to Bystedt, U.S. Pat. No. 4,034,870, issued July 12, 1977 to Duch, U.S. Pat. No. 3,687,749, issued Aug. 29, 1972 to Reinhall.

GENERAL DESCRIPTION OF THIS INVENTION

Accordingly, it is an aim of one aspect of this invention to provide an improved centrifugal grinding method and apparatus in which a pressure differential is placed across a "plug" of woodchips within the rotor pocket, in order to add a further increment of pressure urging the woodchips against the surface, thus permitting slower rotational speeds without sacrificing grinding force.

It is an ancillary aim of an aspect of this invention to achieve the foregoing in such a way that the discharge of pulp from the centrifugal grinder is pressurized above atmospheric in a controlled manner, thus permitting a range of discharge temperatures above the normal boiling point for water.

More particularly this invention provides a method of grinding woodchips into pulp, utilizing an internal grinding surface of circular section which defines a cavity in which is rotatably mounted a rotor that provides at least one pocket extending to said grinding surface from an inlet spaced inwardly from said grinding surface, the method including the steps of delivering woodchips to said pocket, forming a compact plug of woodchips in said pocket by rotating said rotor which gives rise to centrifugal force urging said woodchips against said grinding surface, grinding said plug of woodchips to pulp by continued rotation of said rotor, placing a gaseous pressure differential across said plug of woodchips while in said pocket to further urge said plug towards said grinding surface, and removing said pulp from said surface to a discharge, said gaseous pressure differential ensuring that the woodchips are pressed against said surface with a satisfactory grinding force without requiring an excessive rotor rotational speed.

Further, this invention provides an apparatus for grinding woodchips to pulp, comprising:

first means providing an internal grinding surface of circular section which defines a cavity, a rotor mounted for rotation in said cavity, a pocket in said rotor extending to said grinding surface from an inlet spaced inwardly from said grinding surface, whereby woodchips entering at said inlet can be urged centrifugally against said surface to form a compact plug of material filling the pocket adjacent the surface, a discharge from said surface, along which pulp can exit from the apparatus, and second means, operatively associated with said pocket for placing a gaseous pressure differential across the said plug of material in the sense to urge the woodchips more strongly against the grinding surface, so that the woodchips can press with a satisfactory grinding force against the surface without requiring an excessive rotational speed.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
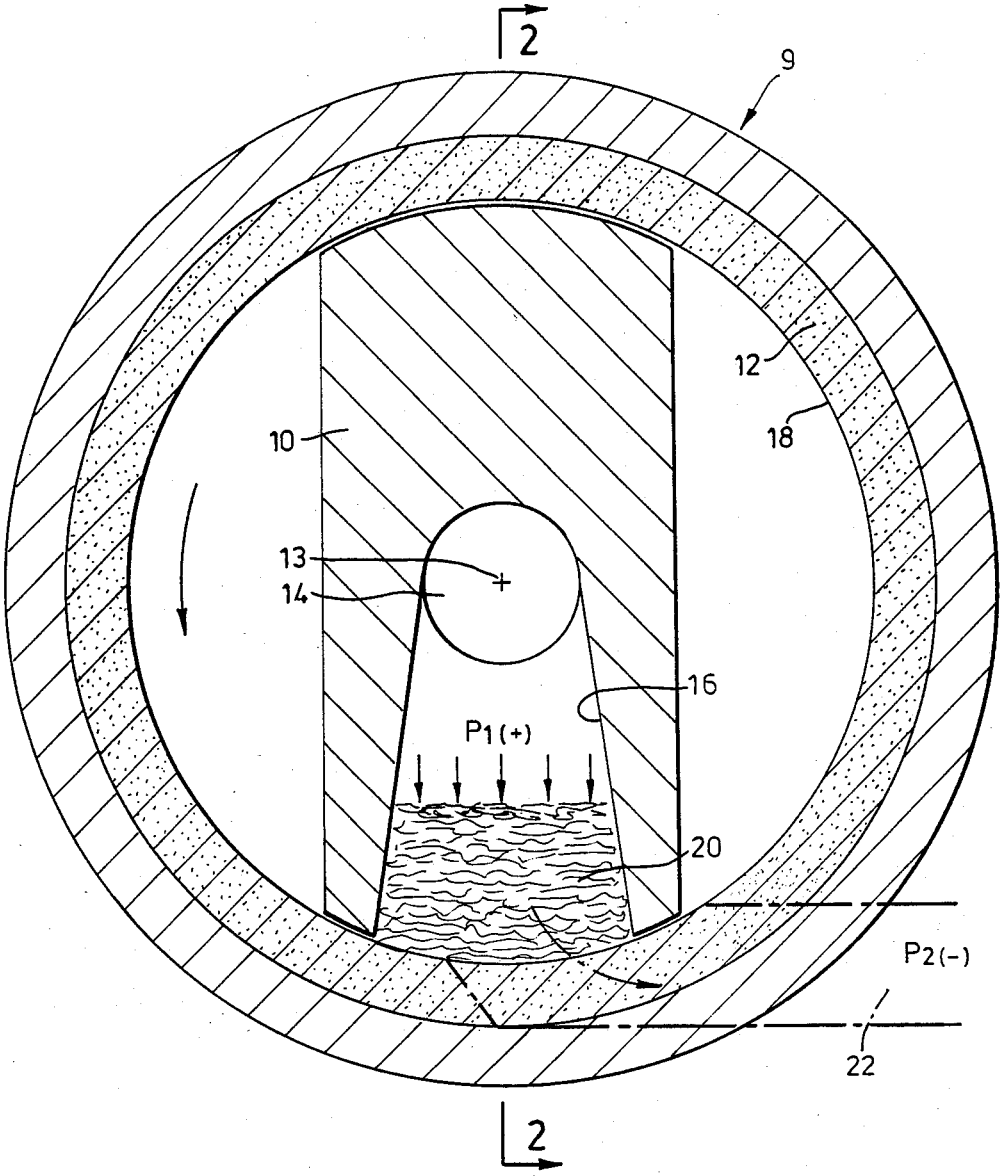
FIG. 1 is a cross-sectional view of a centrifugal grinder constructed in accordance with this invention, taken at the line 1—1 in FIG. 2.
Figure 2:
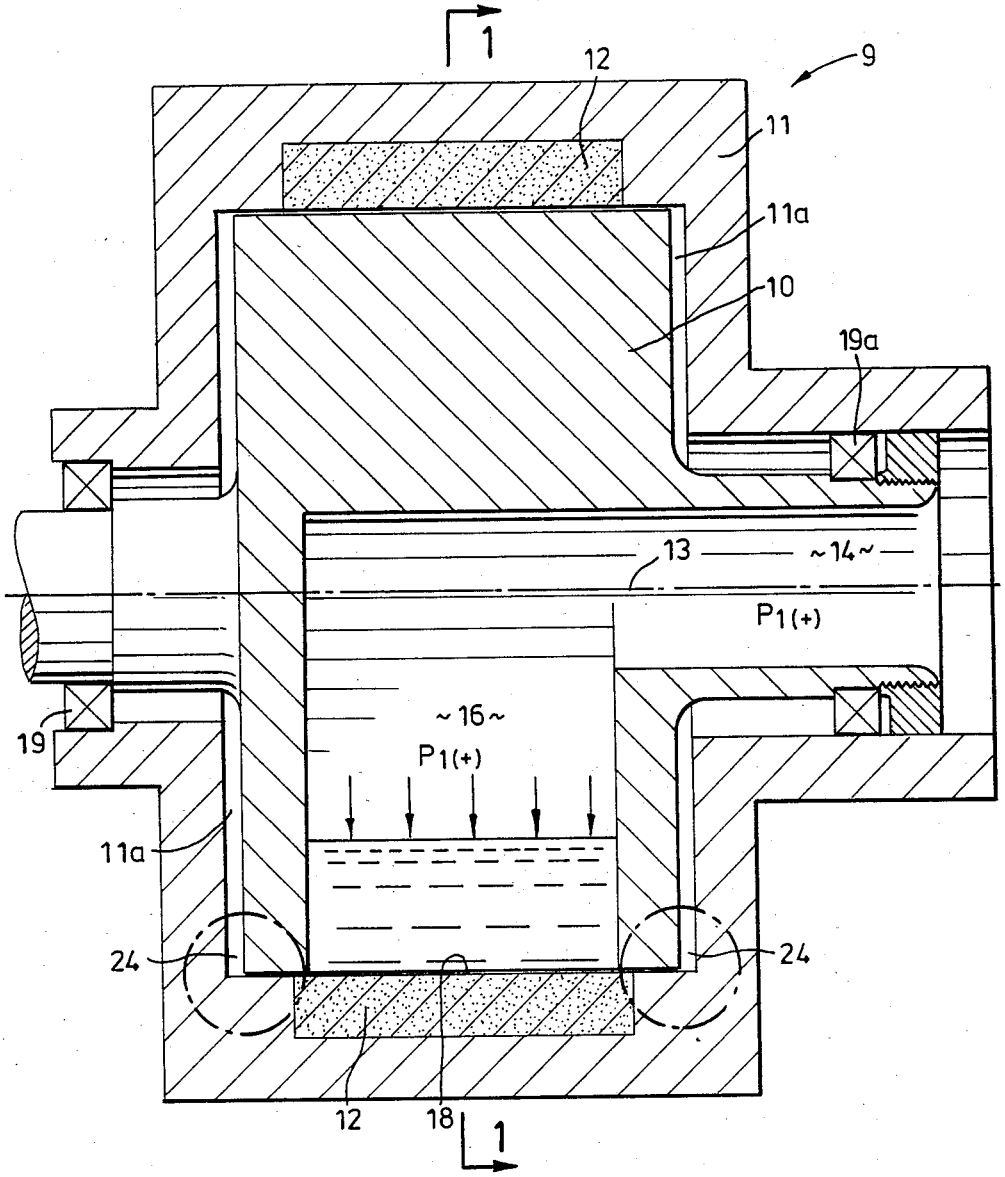
FIG. 2 is an axial sectional view taken at the line 2—2 in FIG. 1.

In FIGS. 1 and 2, a centrifugal grinder 9 is shown, having a rotor 10 rotating within a stationary grinding stone 12 held by an external housing 11. The housing 11 defines a cavity 11*a* for the rotor 10. The rotor rotates about an axis 13, and has an axial inlet 14 for woodchips. The rotor 10 further defines a pocket 16 which extends from the inlet 14 to the surface 18 of the grinding stone 12. The pocket 16 thus allows woodchips to have access to the surface 18. Bearings 19 and 19*a* mount the rotor 10 for rotation with respect to the housing 11. The pulp slurry exits from the grinder along a tangential discharge conduit 22 communicating with end regions 24 of the cavity 11*a*.

The rotor 10 is rotated at a substantial speed by means not shown, and centrifugal forces urge the woodchips against the surface of the stone 12. As previously explained, if the rotational speed is high enough, the centrifugal forces will be sufficient to generate the necessary pressures for grinding. However, it has been found that linear speeds at the grinding stone surface 18 greater than about 5,000 feet per minute may not produce satisfactory pulp quality. The solution offered by the present invention is to slow the rotor down so that the linear speed is close to the desired 5,000 feet per minute, and then to provide the additional grinding pressure by allowing the slurry 20 of woodchips within the pocket 16 to form an effective plug against which pressure can be maintained. By maintaining a pressure differential across the woodchip plug 20, an incremental force can be added to the forces generated centrifugally, thus contributing part of the radial grinding force. This permits the rotor to be slowed down to more conventional surface speeds.

As an example, the discharge pressure P2 in the discharge conduit 22 could conveniently be on the order of two atmospheres, thus preventing boiling of the slurry when discharging at temperatures of around 260° F. The pressure P1 at the inlet 14, and thus upstream of the woodchip plug, could conveniently be approximately 5 atmospheres. The resultant radial grinding pressure would be 3 atmospheres, or approximately 50 psi.

The total grinding force per square inch would therefore be the sum of this latter figure, plus whatever is generated by the rotational centrifugal forces.

Figure 3:
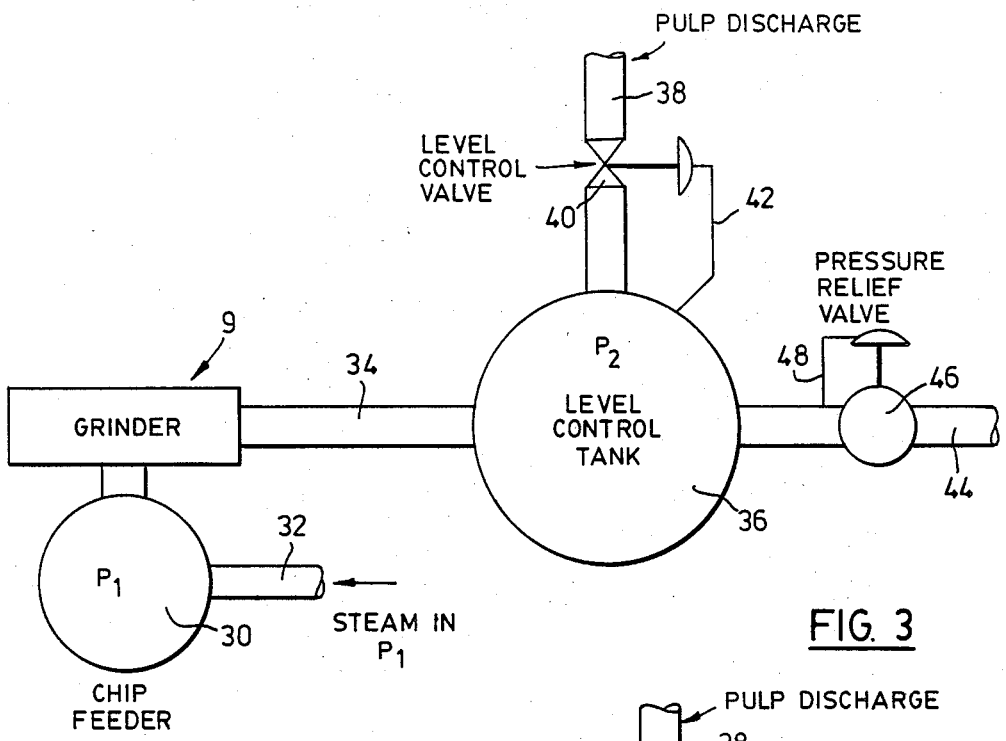
FIG. 3 is a schematic diagram of a first embodiment of the pressure control system for the centrifugal grinder of this invention.

Attention is now directed to FIG. 3, which shows the centrifugal grinder schematically at 9, the grinder 9 receiving woodchips from a chip feeder 30. Pressurized steam is admitted to the chip feeder 30 at a steam entry through a conduit 32. The ground pulp slurry exits from the grinder along a conduit 34 communicating with the conduit 22 shown in FIG. 1, and enters a level control tank 36. A pulp discharge pipe 38 removes pulp from the level control tank 36, the discharge pipe 38 having a control valve 40 with a sensing line 42 back to the control tank 36. A pressure relief conduit 44 connected to the control tank 36 has a pressure relief valve 46 activated through a sensing line 48 communicating with the conduit 44 upstream of the valve 46.

The pressure relief valve 46 is adjusted to maintain a pressure P2 in the level control tank, and thus in the discharge conduit 22 of the grinder 9, which is below the steam pressure being admitted to the chip feeder 30 by a predetermined pressure differential which it is desired to maintain across the woodchip plug 20 (see FIG. 1).

Figure 4:
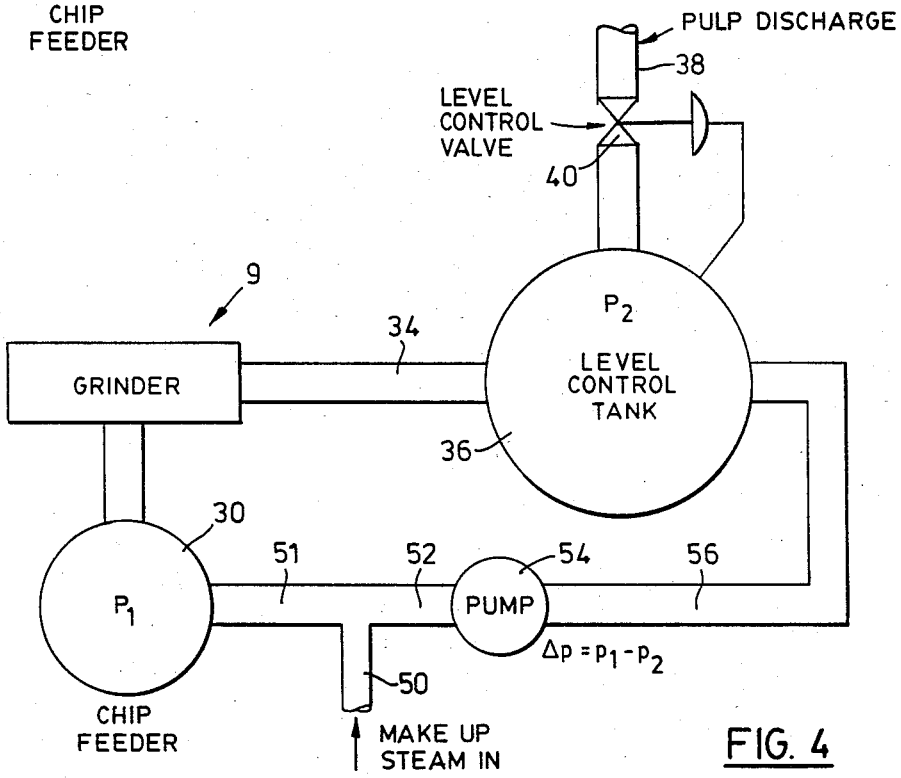
FIG. 4 is a schematic diagram of a second embodiment of the pressure control system for the centrifugal grinder of this invention.

In the alternative embodiment shown in FIG. 4, make-up steam enters along a pipe 50 which branches into a first line 51 through which the steam can enter the chip feeder 30, and a second line 52 connected with the high pressure or discharge side of a pump 54. The suction or low pressure side of the pump 54 is connected to a line 56 that communicates with the level control tank 36, thus replacing the conduit 44 and the pressure relief valve 46 which are shown in the FIG. 3 embodiment. As with the earlier embodiment, the level control tank 36 also includes the pulp discharge pipe 38 and the level control valve 40. A conduit 34 conducts the pulp slurry from the grinder 9 to the control tank 36.

It will thus be appreciated that the pump will typically maintain a particular pressure differential, which will automatically be that applied across the woodchip plug 20 seen in FIG. 1.

While one embodiment of this invention has been illustrated in the accompanying drawing, and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A method of grinding woodchips into pulp, utilizing an internal grinding surface of circular section which defines a cavity in which is rotatably mounted a rotor that provides at least one pocket extending to said grinding surface from an inlet spaced inwardly from said grinding surface, the method including the steps of delivering woodchips to said pocket, forming a compact plug of woodchips in said pocket by rotating said rotor which gives rise to centrifugal force urging said woodchips against said grinding surface, grinding said plug of woodchips to pulp by continued rotation of said rotor, placing a gaseous pressure differential across said plug of woodchips while in said pocket to further urge said plug towards said grinding surface, and removing said pulp from said surface to a discharge, said gaseous pressure differential ensuring that the woodchips are pressed against said surface with a satisfactory grinding force without requiring an excessive rotor rotational speed.

2. The method claimed in claim 1, in which both the pressure upstream of the plug and the pressure downstream of the plug are above atmospheric, whereby the pulp may be discharged, without boiling, at a temperature in excess of the boiling temperature of water at atmospheric pressure.

3. The method claimed in claim 2, in which the pressure upstream of the plug is substantially 5 atmospheres, and the pressure downstream of the plug is substantially 2 atmospheres.

4. The method claimed in claim 3, in which the woodchips, prior to being introduced into said pocket, are steamed.

5. The method claimed in claim 2, in which the woodchips, prior to being introduced into said pocket, are steamed.

6. The method claimed in claim 1, in which the pressure differential is substantially 3 atmospheres.

7. The method claimed in claim 2, in which the woodchips, prior to being introduced into said pocket, are steamed.

8. The method claimed in claim 1, in which the woodchips, prior to being introduced into said pocket, are steamed.

9. Apparatus for grinding woodchips to pulp, comprising:

first means providing an internal grinding surface of circular section which defines a cavity, a rotor mounted for rotation in said cavity, a pocket in said rotor extending to said grinding surface from an inlet spaced inwardly from said grinding surface, whereby woodchips entering at said inlet can be urged centrifugally against said surface to form a compact plug of material filling the pocket adjacent the surface, a discharge from said surface, along which pulp can exit from the apparatus, and second means operatively associated with said pocket for placing a gaseous pressure differential across the said plug of material in the sense to urge the woodchips more strongly against the grinding surface, so that the woodchips can press with a satisfactory grinding force against the surface without requiring an excessive rotational speed.

10. The apparatus claimed in claim 9, in which said second means provides superatmospheric pressure both upstream and downstream of the plug, whereby the pulp may be discharged, without boiling, at a temperature in excess of the boiling temperature of water at atmospheric pressure.

11. The apparatus claimed in claim 10, in which the second means establishes a pressure of substantially 5 atmospheres upstream of the plug, and a pressure of substantially 2 atmospheres downstream of the plug.

12. The apparatus claimed in claim 9, in which the pressure differential established by said second means is substantially 3 atmospheres.

* * * * *